US005174207A

United States Patent [19]

Wallmann et al.

[11] Patent Number: 5,174,207

[45] Date of Patent: Dec. 29, 1992

[54] ROTARY PRINTING MACHINE

[75] Inventors: Wilfried Wallmann, Lengerich; Günter Rogge, Lienen, both of Fed. Rep. of Germany

[73] Assignee: Windmoller & Holscher, Lengerich, Fed. Rep. of Germany

[21] Appl. No.: 708,666

[22] Filed: Jun. 3, 1991

[30] Foreign Application Priority Data

Jun. 1, 1990 [DE] Fed. Rep. of Germany ..... 4017799

[51] Int. Cl.[5] ..... B41F 5/04; B41L 15/00

[52] U.S. Cl. ..... 101/216; 101/DIG. 48

[58] Field of Search ..... 101/216, 219, DIG. 48, 101/93.13, 93.14, 105; 198/832, 834; 226/76, 75, 87; 474/158, 159, 164

[56] References Cited

U.S. PATENT DOCUMENTS 4,817,525 4/1989 Yagi ..... 101/DIG. 48

FOREIGN PATENT DOCUMENTS 448987 9/1927 Fed. Rep. of Germany .
1786507 1/1973 Fed. Rep. of Germany .
8122637.3 7/1982 Fed. Rep. of Germany .
2601290 1/1988 France .

*Primary Examiner*—J. Reed Fisher
*Attorney, Agent, or Firm*—Fleit, Jacobson, Cohn, Price, Holman & Stern

[57] ABSTRACT

This invention refers to a rotary printing machine with at least one counterpressure cylinder and at least two printing belt cylinders around which a continuous printing belt carrying printing forms and printing pictures is led, with one cylinder thereof being provided with a radial ring of pins in the region of each of its ends, wherein the pins thereof mesh with holes of edge-side tracks of holes of the printing belt for a slip-free guiding of the latter. For the solution of the problem to develop a rotary printing machine of that kind which can be easily and rapidly converted for continuous printing belts of different width without exchanging the printing cylinder, the printing belt cylinder is provided with bores at a distance from the end-side pin rings on at least one circumferential line corresponding to the distance of the pin spacing of the pin rings, in which extendable and retractable pins are arranged.

8 Claims, 2 Drawing Sheets

ROTARY PRINTING MACHINE

BACKGROUND OF THE INVENTION

1. Field of the Invention

This invention refers to a rotary printing machine with at least one counterpressure cylinder and at least two printing belt cylinders around which a continuous printing belt carrying printing forms and printing pictures is led, with one cylinder thereof being provided with a radial ring of pins in the region of each of its ends, wherein the pins thereof mesh with holes of edge-side tracks of holes of the printing belt for a slip-free guiding of the belt.

2. Description of Background Art

Rotary printing machines of said kind which are provided with continuous printing belts, by which the format length can be increased independent of the diameters of the printing belt cylinders which form idler rollers, are already known in the art for instance from the German Utility Model G 81 22 637.3 and the German Pat. No. 448 987.

For changing of the format length it is known to change the distances between the axis of the two printing belt cylinders and to lead therearound a correspondingly shortened continuous printing belt.

Often there is the necessity to carry out the printing with continuous printing belts which have a smaller width. Such printing belts can be used, if the associated printing belt cylinder is replaced by such of a suitable width, which, however, renders necessary an increased expenditure in conversion and furthermore the storing of printing belt cylinders of different width.

SUMMARY OF THE INVENTION

It is the object of the invention to develop a rotary printing machine of the kind mentioned hereinbefore, which can be easily and rapidly converted for utilizing continuous printing belts of different widths without exchanging the printing belt cylinders.

According to the invention, this problem is solved for a rotary printing machine of the generic type in that the printing belt cylinder is provided with a circumferential row of bores spaced from the end pin rings toward the longitudinal center of the cylinder. The bores being spaced along at least one circumferential line at a distance corresponding to the pin spacing of the end pin rings. Extendable and retractable pins are arranged within the bores. If the rotary printing machine according to the invention, which is a flexographic printing machine or any other kind of printing machine, is to be converted to use a smaller width of continuous printing belt, the pins arranged in an immersed position in the bores are extended so that they form a suitable central pin ring. The new continuous printing belt can be installed in a usual manner, wherein the ends of the printing belt which are provided with tooth rows being undercut in a dovetailed form are brought into a positive engagement with each other.

Advantageously, the force of a spring is applied to bias the pins in direction to retract the pins into the bores. In this development, actuators are required to only press the pins against the force of the springs out of the bores and hold them in their extended positions. The pins may have heads at their inner ends which with the flat shanks of the pins, form annular shoulders on which the springs are supported. Advantageously, the springs are leaf springs which are provided with bores for holding and biasing the pins.

Accordingly to an advantageous development, for the extension and retraction of the pins, a truncated ring being axially movable along the cylinder is provided which has a tapered outside surface with which the heads of the pins are held in contact by means of the springs.

In a further development according to the invention, the tapered ring is connected to at least one operating rod which is reciprocally movable in the axial direction by a spindle drive. Advantageously, a spindle is arranged in an axial bore through a shaft journal of the printing belt cylinder. The spindle is reciprocally movable by a spindle nut being rotatably but axially stationary mounted at the outer end of the journal. The spindle carries a crossbar at its inner end, at the ends of the crossbar the ends of two such operating rods are attached.

According to a further development of the invention, the printing belt cylinder has bores or annular grooves at its ends which define extending annular edges of the printing belt cylinder. The extending edges are provided with radial bores for the end pin rings at a distance corresponding to the pin track spacing of the belt. In the grooves or bores, rings with truncated sections are insertable and can be detachably fixed therein. The pins are supported on the truncated ring sections such that, the shoulders of the pin heads are held in contact with the inner edges of the radial bores. Said development of the invention permits the rapid exchange of the pins of the end pin rings of the printing belt cylinder, for instance in case of wear, by new pins.

When both journals of the printing belt cylinder are provided with spindle drives for extension and retraction of pins of central pin rings being arranged between the end pin rings, the printing belts with their perforations can mesh with the pins of the end pin rings or even with the pins of one end pin ring and one central pin ring or with the pins of both central pin rings. Thus, the rotary printing machine according to the invention can be rapidly and easily converted for printing belts of different widths.

One embodiment of the invention will now be described in the following with reference to the drawing.

DETAILED DESCRIPTION OF PREFERRED EMBODIMENT

Figure 1:
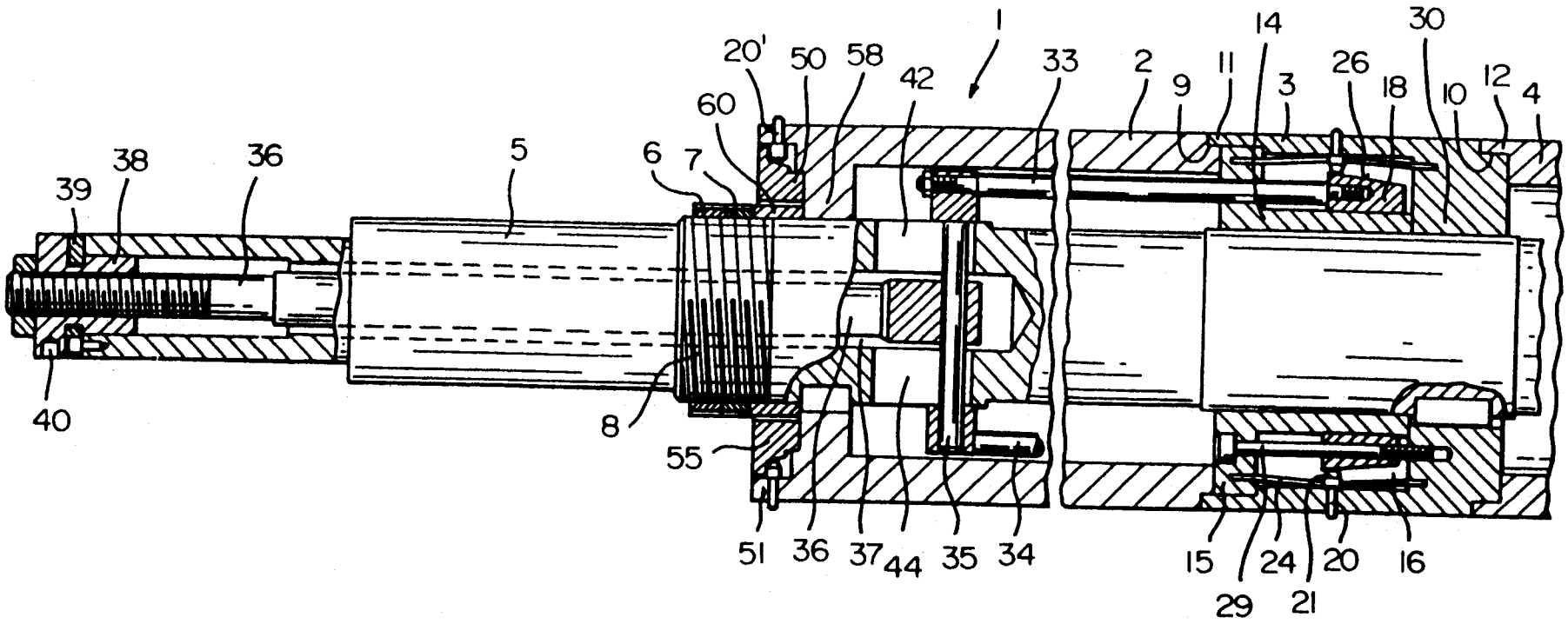
FIG. 1 is a longitudinal section through the left half of a printing belt cylinder of the invention, the right half (not shown) is a mirror-image of the left half.

The sleeve of the printing belt cylinder 1 is composed of annular sections 2, 3, 4, which are mounted on the continuous shaft 5. The individual annular sleeve sections 2, 3, 4 are braced against each other by nuts 6, 7 which are screwed on a threaded section 8 of the shaft 5. Between the center sleeve section 4 and the end sleeve section 2, the sleeve section 3 is fixed and is provided with three bore sections of different diameters. The sleeve sections 2, 3 have at one end annular shoulders 9, 10, with which the projecting annular edge sections 11, 12 of the adjacent sleeve sections mesh. The annular front surfaces of the projecting edge sections bluntly contact the radial annular steps of the shoulders.

Between the annular sleeves sections 2, 3 an inner annular spacer 14 is mounted which has an annular flange 15 which is fixed in the represented manner between a inner edge of the section 2 and an inner ring step of the section 3. The annular spacer 14 defines an annular chamber 16 within the sleeve section 3, in which a ring 18 with a trapezoidal cross-section and a tapered outer lateral surface and flat inner lateral surface which is guided for axial movement of ring 18 on the outer lateral surface of the flat cylindrical sleeve of the spacer 14.

The annular cylindrical section 3 is provided with radial bores spaced in a circumferential line at a distance corresponding to the spacing of the end pin rings, in which the shanks 20 of pins are mounted and guided. The inner ends of the pins have rounded conical heads 21. The shanks 20 of the pins are mounted in bores of leaf springs 24 and the ends of the springs mounted in slits of the sleeve section 3 and annular flange 15 of the spacer 14 such that they strive to move the pins radially towards the inside. The inner conical heads 21 of the pins are supported on the tapered sleeve surface 26 of the ring 18.

The ring 18 is provided with through-bores through which the clamping screws 29 pass which brace the spacer ring 14 with the radially inwardly pointing ring shoulder 3 of the cylinder section 3. The thread-free shanks of the clamping screws 29 are used as guide rods for the ring 18, two operating rods 33, 34 are screw-connected, the other ends of the rods are connected to the ends of a transverse bar 35. At its center region, the bar 35 is fixed in a transverse bore through the inner end of a spindle 36. The spindle 36 is arranged in a central bore 37 of the inner end of shaft 5. Onto the outer threaded end of the spindle 36, a threaded nut 38 is screwed. The smooth outer lateral surface of the cylindrical nut 38 engages in the journal bore 37 through a flat outer cylindrical part. The nut 38 is provided with an annular groove with which a holding ring 39 engages which is screw-connected into the end of the journal of shaft 5. The spindle nut 38 is provided with a radial bore 40 into which an operating key may be engaged, so that the spindle nut can be rotated for axial displacement of the truncated ring 18 for extension and retraction of the pins of the central pin ring.

The cross-bar connected with the inner end of the spindle 36 extends through opposed elongated holes 42, 44 of the shaft 5 to prevent rotation of the spindle 36.

The edge section 2 of the printing belt cylinder is provided at its front surface with a circumferential groove 50 forming radial ring steps, between a projecting edge 51 and the inner cylindrical wall section of the cylinder section 2. In projecting edge section 51, a circumferential row of radial bores are arranged at a circumferential distance corresponding to the belt track pin spacing. The shanks 20' of pins are mounted in the radial bores. In the annular recess 50, an annular holding part 55 is inserted which has a tapered step on which the conical heads of the pins are supported in such a manner that the shoulders of the pin heads are held in engagement with the inner edges of the radial bores. The holding ring 55 is inserted into annular recess 50 which is closed by an outer radial wall of the holding ring. The holding ring 55 is braced with the cylinder section 2 such that the inner annular side of the holding ring is supported on a radial ring step of the cylindrical section 2.

Between the clamping nuts 6, 7 and the inwardly extending ring web 58 of the outer section 2 of the printing belt cylinder a spacer ring 60 transmitting the tension is arranged.

Figure 2:
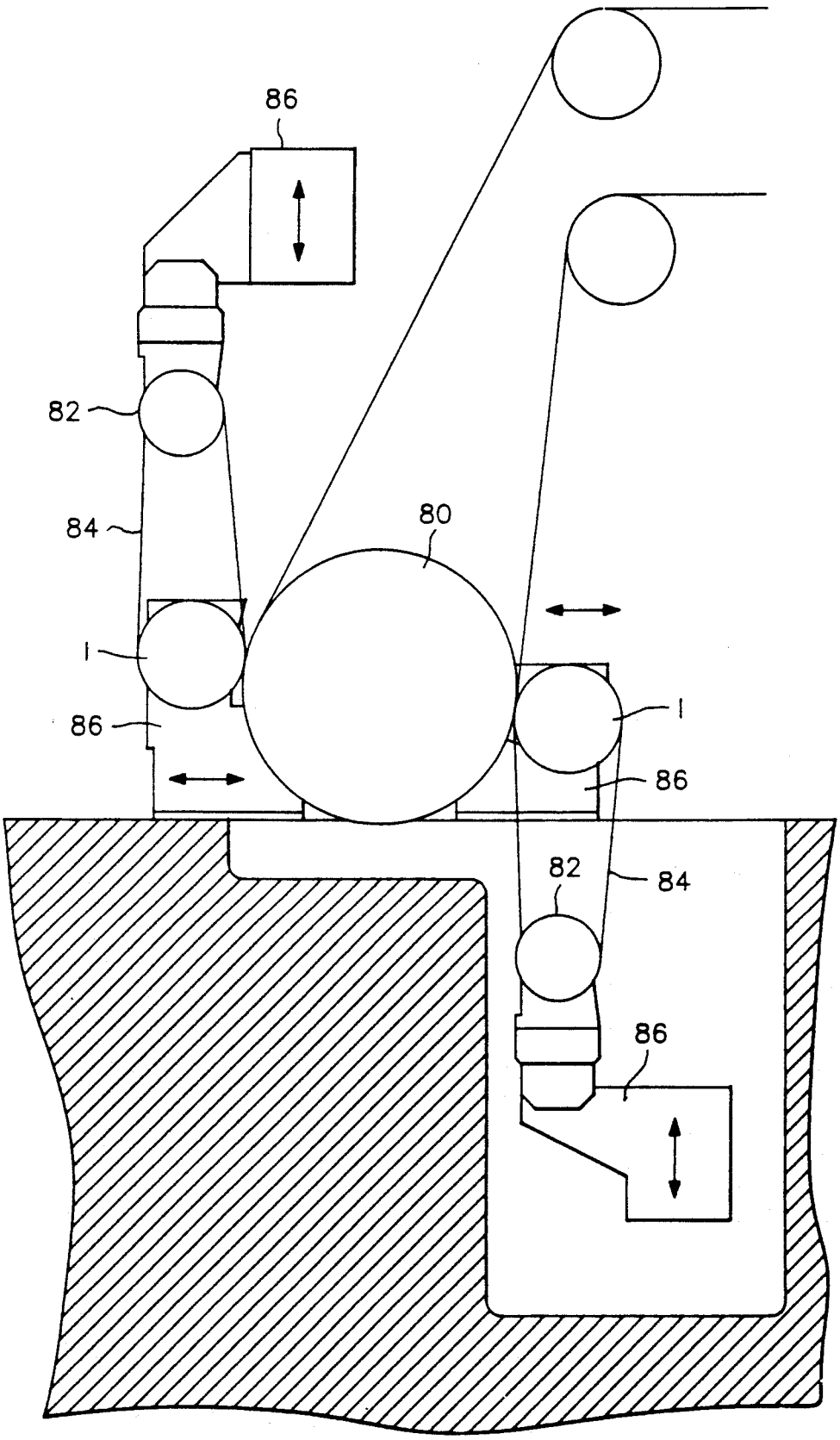
FIG. 2 is a diagramtic view of a printing machine having printing belt cylinders as shown in FIG. 1.

As shown in FIG. 2, printing belt cylinders 1 according to the invention can be used in a printing machine having a counterpressure cylinder 80. The printing belt cylinders 1 may be used in combination with conventional printing belt cylinders 82 to mount printing belts 84. References 86 denote mounting pedestals for the respective belt cylinders.

What is claimed is:

1. Rotary printing machine with at least one counterpressure cylinder and at least two printing belt cylinders around which a continuous printing belt carrying printing forms and printing pictures is led, with at least one cylinder thereof comprising:

a circumferential ring of radial pins in the region of each of its ends for meshing with edge tracks of holes in the printing belt for slip-free guiding of the belt;

bores spaced toward the longitudinal center of the cylinder from the end pin rings in at least one circumferential line with bore spacing corresponding to the distance of the pin spacing of the pin rings; and extendable and retractable radial pins arranged in the bores for meshing with narrower belts.

2. Rotary printing machine according to claim 1, in which springs apply force to the radial pins in the bores for directing the pins to move towards the central axis of the one printing belt cylinder.

3. Rotary printing machine according to claim 1, in which the radial pins in the bores have heads at their radially inner ends which form annular shoulders on which the springs are supported.

4. Rotary printing machine according to claim 2, wherein the springs are leaf springs which are provided with bores for holding the pins.

5. Rotary printing machine according to claim 2, in which for the extension and retraction of the pins in the bores a ring being axially movable is provided which has a lateral tapered outside surface with which the inner ends of the pins are held in contact by means of the springs.

6. Rotary printing machine according to claim 5, wherein the ring is connected with at least one operating rod which is reciprocally movable in axial direction by a spindle drive.

7. Rotary printing machine according to claim 6, wherein a spindle is arranged in a bore of a shaft journal of the one printing belt cylinder, and the spindle is reciprocally movable by a spindle nut being rotatably but axially stationary mounted at the end of the journal, and wherein the spindle carries a crossbar at its inner end, at the ends of which the ends of two operating rods are attached.

8. Rotary printing machine according to claim 1, wherein the one printing belt cylinder has annular grooves at its ends which are limited on the radial outside by extending annular edges of the one printing belt cylinder, wherein the edges are provided with radial bores for the pins at a distance corresponding to the spacing of holes in the belt, wherein the grooves, rings with truncated sections on their outer sleeve surfaces are insertable and can be detachably fixed therein, and wherein the pins are supported on the truncated sleeve sections by inner heads of the pins such that annular shoulders formed between the heads and the shanks of the pins are held in contact with the inner edges of the radial bores.

* * * * *